US008381448B2

(12) United States Patent
Flory et al.

(10) Patent No.: US 8,381,448 B2
(45) Date of Patent: Feb. 26, 2013

(54) ADJUSTABLE DOOR SWEEP

(75) Inventors: Leo R. Flory, Decatur, MI (US); Andrew J. Seiser, Schoolcraft, MI (US)

(73) Assignee: Special-Lite, Inc., Decatur, MI (US)

( * ) Notice: Subject to any disclaimer, the term of this patent is extended or adjusted under 35 U.S.C. 154(b) by 333 days.

(21) Appl. No.: 12/799,865

(22) Filed: May 4, 2010

(65) Prior Publication Data

US 2011/0271601 A1 Nov. 10, 2011

(51) Int. Cl.
*E06B 1/70* (2006.01)

(52) U.S. Cl. ..... 49/468; 49/467; 49/303; 49/306; 49/307

(58) Field of Classification Search ..... 49/303, 49/306–314, 467–470
See application file for complete search history.

(56) References Cited

U.S. PATENT DOCUMENTS

| | | | | | |
|---|---|---|---|---|---|
| 728,686 | A | * | 5/1903 | Douden et al. | 49/307 |
| 1,145,539 | A | * | 7/1915 | Bauer | 49/307 |
| 1,561,195 | A | * | 11/1925 | Szymkowiak | 49/307 |
| 1,771,599 | A | * | 7/1930 | Wilson | 49/309 |
| 2,555,244 | A | | 5/1951 | Pietrushak | |
| 2,820,261 | A | * | 1/1958 | Brown | 49/306 |
| 2,917,796 | A | | 12/1959 | Kunkel | |
| 3,072,977 | A | * | 1/1963 | Burda | 49/307 |
| 3,114,946 | A | * | 12/1963 | Fluck | 49/470 |
| 3,504,456 | A | * | 4/1970 | Frederick, Jr. | 49/470 |
| 3,668,807 | A | * | 6/1972 | Thompson | 49/482.1 |
| 4,089,136 | A | * | 5/1978 | Lapinski et al. | 49/308 |
| 4,205,498 | A | * | 6/1980 | Unayama | 52/243.1 |
| 4,852,302 | A | | 8/1989 | Gil | |
| 6,082,047 | A | * | 7/2000 | Comaglio et al. | 49/308 |

FOREIGN PATENT DOCUMENTS

EP 0 579 950 A1 1/1994

* cited by examiner

*Primary Examiner* — Katherine Mitchell
*Assistant Examiner* — Marcus Menezes
(74) *Attorney, Agent, or Firm* — Flynn, Thiel, Boutell & Tanis, P.C.

(57) ABSTRACT

An adjustable door sweep with an upper frame, a lower carrier, and at least one brush is provided. The adjustable door sweep includes diagonally oriented slots in the walls of the upper frame and the lower carrier with attached rotatable rods to assist in vertical adjustment of the extensions, such as brushes. The method of using such an adjustable door sweep is also provided.

17 Claims, 3 Drawing Sheets

ADJUSTABLE DOOR SWEEP

FIELD OF THE INVENTION

The present invention generally relates to door sweeps and seals, and more specifically relates to door sweeps that are adjustable.

BACKGROUND OF THE INVENTION

The installation of a hinged door often results in a gap between the threshold and the bottom of the door. To prevent, or at least minimize, flow of air and light through such a gap, devices such as weather stripping, seals, and brushes have been used on or adjacent the bottom of a door. However, such devices are typically a predetermined, non-adjustable height and therefore may not fit within the gap or alternatively may, even when installed, leave a small gap.

To account for this deficiency in fixed-height weather proofing and sealing devices, adjustable weather stripping and seals have been used. However, such adjustable weather stripping and seals have typically been complex in nature and allow only one adjustment, that being in the vertical direction, of the entire seal or weather strip.

The present inventors designed a door sweep which is cost effective to make and buy, allows adjustment of both ends of the door sweep independently, and is easy to use.

One embodiment of the present invention includes a door with an adjustable door sweep. The adjustable door sweep includes an elongated upper frame, an elongated lower carrier, and an extension attached to the elongated lower carrier. The elongated upper frame preferably includes a top and at least one upper side wall depending from the top, the upper side wall having a first aperture adjacent one end and a second aperture adjacent the other end. The elongated lower carrier preferably includes an elongated base wall and at least one vertical wall extending upwardly from the base wall. The extension, which may be a brush, is attached to the elongated lower carrier and extends downwardly. The adjustable door sweep also preferably includes a first connecting member, such as a pin, engaged with the lower side wall and extending through the first aperture in the upper side wall, and a second connecting member engaged with the lower side wall and extending through the second aperture in the upper side wall. The first and second apertures are sized and shaped to allow movement of the connecting members to allow independent vertical movement of the ends of the lower carrier for adjustment of the extension relative to the upper frame.

The present invention also includes a method of using an adjustable door sweep such as that just described. The method preferably includes installing an adjustable door sweep onto a door, or providing a door with such an adjustable door sweep. Once installed, the first connecting member of the adjustable door sweep is moved with respect to the upper frame side wall to the desired position within the first aperture and the second connecting member is moved with respect to the upper frame side wall to the desired position within the second aperture, to independently adjust both ends of the extension vertically.

Other objects and purposes of the invention, and variations thereof, will be apparent upon reading the following specification and inspecting the accompanying drawings.

Figure 1:
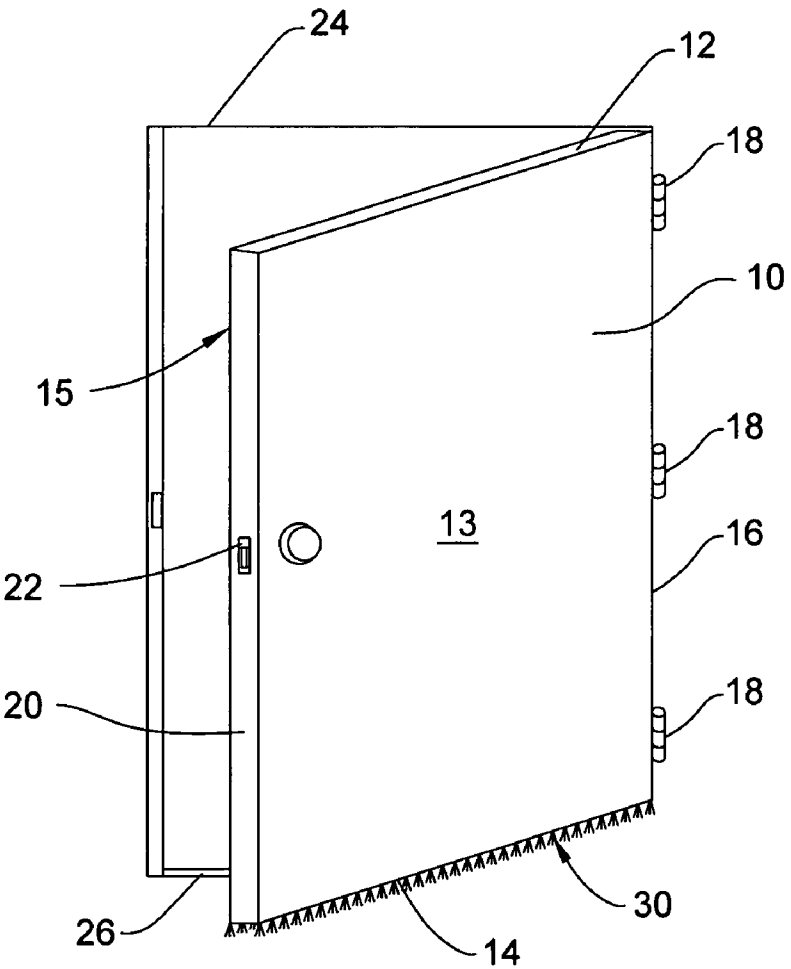
FIG. 1 is an elevational view of a door embodying the present invention.
Figure 2:
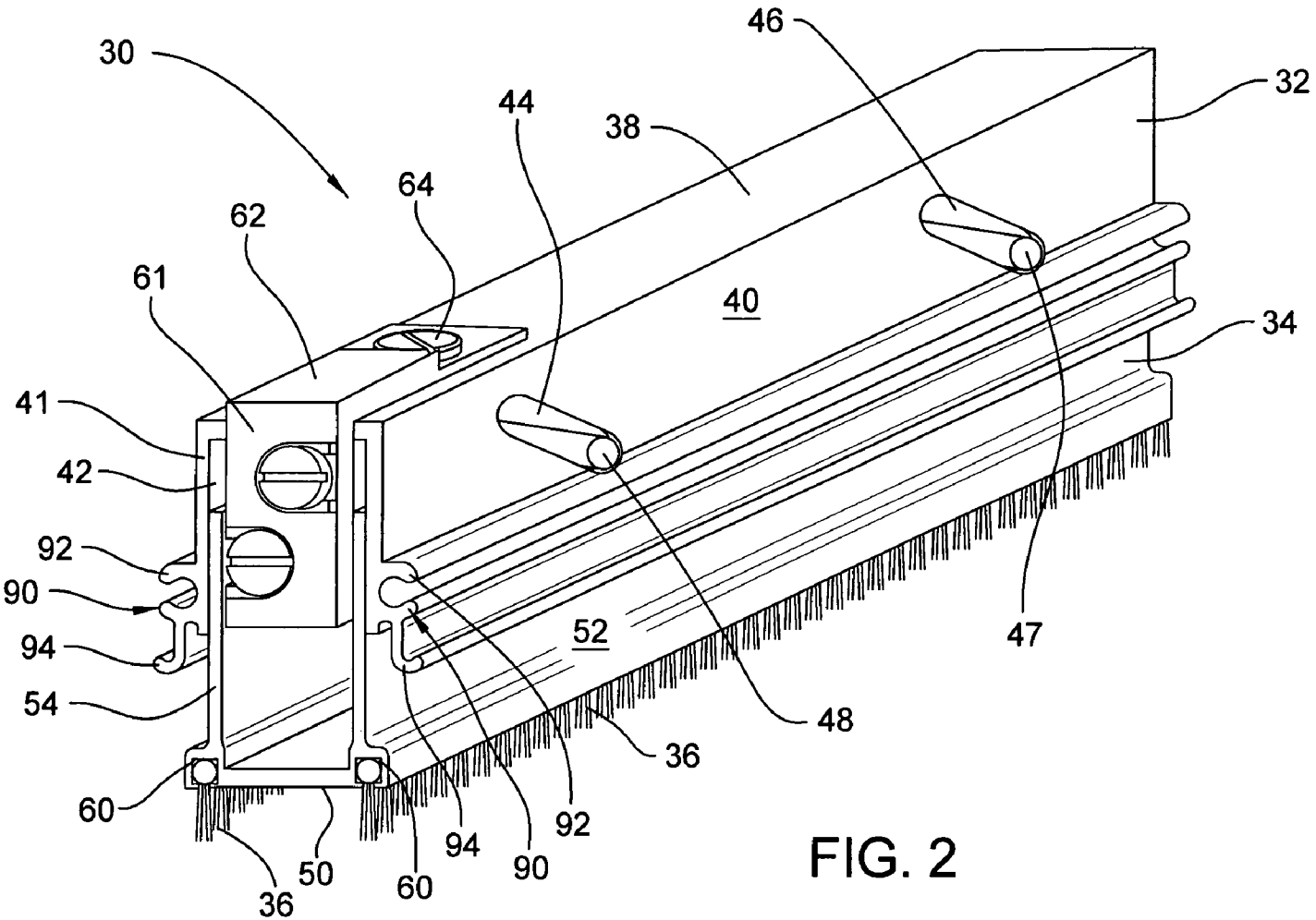
FIG. 2 is a perspective view of an adjustable door sweep embodying the present invention.
Figure 3:
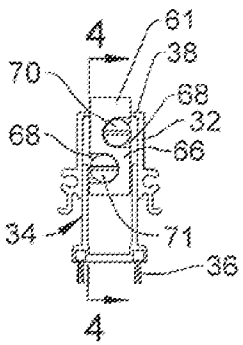
FIG. 3 is an elevational end view of the adjustable door sweep of FIG. 2.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the adjustable door sweep arrangement and designated parts thereof. Said terminology will include the words specifically mentioned, derivatives thereof, and words of similar import.

DETAILED DESCRIPTION OF THE PREFERRED EMBODIMENT

Referring to the figures, FIG. 1 shows a door 10 which has a top 12, a bottom 14, a hinge side 16 adjacent and attached to hinges 18, and a lock side 20 which includes a latch or lock 22. Door 10 sits within a frame 24 and when closed resides above a threshold 26 which is adjacent the bottom 14 of the door 10. An adjustable door sweep 30 is adjacent the bottom 14 of the door and is attached to the inside of the door, preferably to both a front panel 13 and a back panel 15 of the door 10.

As shown in FIGS. 2-5, the adjustable door sweep 30 generally includes an upper frame 32, a lower carrier 34, and one or more downwardly projecting extensions 36, and preferably two extensions, one on either side of the adjustable door sweep 30. The extensions 36 are depicted in the drawings as brushes, but may be any type of seal, weather stripping, or block, including, but not limited to vinyl seals, rubber seals, and foam blocks.

The upper frame 32 includes a top wall 38 and two side walls 40, 41 depending from the top wall 38, all of which terminate in two opposing ends 100, 102. Together the top wall 38 and the side walls 40, 41 create an upper channel 42. Both side walls 40, 41 include two slots 44, 46. Slots 44 and 46 are preferably parallel to one another and extend longitudinally in a diagonal direction, that is, skewed from, both the horizontal and vertical directions. The slots 44 and 46 are each sized to receive a connecting member 47, 48, such as pin, which will be discussed in more detail below.

Figure 4:
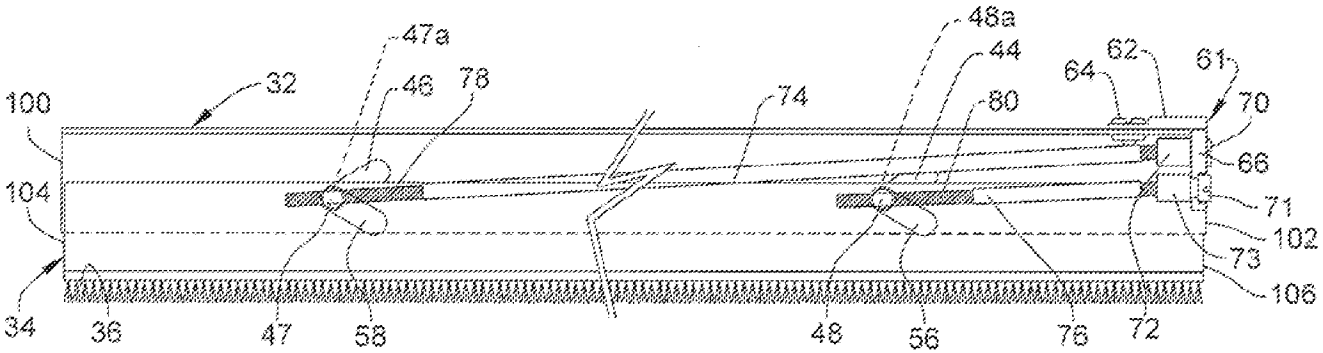
FIG. 4 is a cross-sectional elevational view, taken along line 4-4 in FIG. 3, of the adjustable door sweep of FIG. 2 in an extended position.
Figure 5:
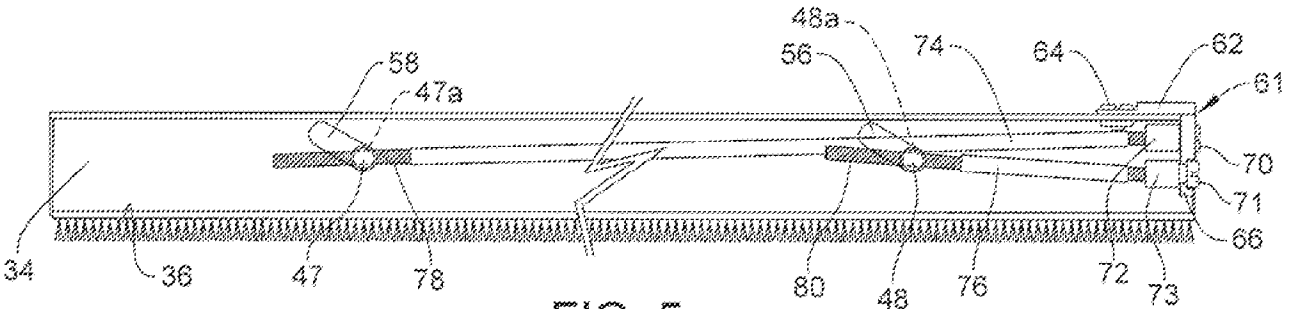
FIG. 5 is a cross-sectional elevational view of the adjustable door sweep of FIG. 4, in a retracted position.

The lower carrier 34 includes a bottom base wall 50 with two lower side walls 52, 54 extending upwardly therefrom, all of which terminate two opposing ends 104, 106. Lower side walls 52, 54 are spaced from one another to leave a gap between them and are spaced so that both side walls 52, 54 fit within upper channel 42. Preferably, lower side walls 52, 54 are disposed adjacent upper side walls 40, 41, respectively. As shown in FIGS. 4 and 5, each lower side wall has two slots 56, 58, which are also oriented diagonally, but in a direction opposite—that is, substantially perpendicular—slots 44, 46, which are respect respectively adjacent to slots 56, 58. Slots 56, 58 extend longitudinally and are each sized to receive connecting member 48, 47, respectively, therein. Thus, connecting member 47 extends through slots 46 and 58, and connecting member 48 extends through slot 44 and 56. Adjacent the bottom base wall 50 are to carrier grooves 60, each of which holds an elongated brush 36.

As shown in FIGS. 2-5, a bracket 61 is attached to the upper frame 32. Bracket 61 is generally L-shaped and includes an upper portion 62 with an aperture (not shown) therein for attachment to the top wall 38 of the upper frame 32 by a fastener 64. Bracket 61 also includes a lower portion 66 that extends downwardly from upper portion 62 and includes two recesses 68. Recesses 68 extend outwardly and are oriented in opposite directions sidewardly with respect to each other, and are each sized to receive a neck portion of an adjustment member, such as an adjusting screw. Two adjusting members 70, 71 are provided, the head portions of which extend outwardly of the bracket 61. The recesses 68 and neck portions of adjusting members 70, 71 are sized relative to each other to allow the adjusting members 70, 71 to pivot a small amount vertically with respect to the bracket 61 as the adjusting members are being turned. Adjusting member 70 includes an inner body 72 that extends inwardly of bracket 61, and includes a bore for attachment to a connecting rod 74. Likewise, adjusting member 71 includes an inner body 73 that extends inwardly of bracket 61, and includes a bore for attachment to a lower connecting rod 76. Upper connecting rod 74 is longer than, and positioned above, connecting rod 76. Connecting rod 74 has a threaded end 78 which is received by a threaded bore 47*a* in connecting member 47. Connecting rod 76 has a threaded end 80 which is received in a threaded bore 48*a* in connecting member 48.

FIG. 4 shows the adjustable door sweep 30 with the brush 36 in an extended position, i.e. in a lower position, and FIG. 5 depicts the adjustable door sweep with the brush 36 in a retracted position, i.e. with a brush 36 in an upper position. The use of the double rod system allows either end (the end adjacent hinge 18 end or the end adjacent lock 22) of the brush 36 to be raised or lowered independent of the other end. Thus, if a threshold or door is uneven, one side of the brush or brushes, for example that closest to the hinge side 16 of the door 10, can be lowered relative to the other (lock) side of the brush 36.

The adjustable door sweep 30 includes one or more attachment members 90 for attachment to the front panel 13 and/or back panel 15 of door 10. The attachment members 90 extend outwardly from upper side walls 40, 41. Each attachment member includes an elongated C-shaped screw boss 92. The screw boss 92 extends along the length of the upper side walls 40, 41 and is shaped and sized to receive a screw, or other fastener, for attachment to a side of a door or to a plate. Each attachment member 90 also includes a flange 94, that is generally J-shaped and extends the length of an upper side wall. Flange 94 is for slidably engaging an elongated member within the interior of a door for attachment of the adjustable door sweep 30 to a door.

In operation, the adjustable door sweep 30 is attached to the inside of the door 10 using the attachment member 90. Alternatively, the adjustable door sweep 30 may be attached to the door by fasteners such as screws. Once installed, one or both ends of brushes 36 may be adjusted vertically. If the side of the brush 36 near the hinge side 16 of the door is desired to be adjusted, adjusting member 71 is turned clockwise or counter-clockwise, depending on whether the brush 36 is to be raised or lowered. Turning adjusting member 71 turns lower connecting rod 76 within connecting member 48 causing connecting member 48 to move within slots 44 and 56, moving the end of the lower carrier 34 adjacent the hinge side 16 vertically and brushes 36 with it. If the side of the brushes 36 closest to the lock side 20 of the door 10 is desired to be adjusted, adjusting member 70 is turned to turn upper connecting rod 74 within connecting member 47.

In this regard, when rod 74 is turned in a clockwise direction, the threaded end portion 78 of the rod 74 turns within threaded bore 47*a* to effectively shorten the length of the portion of the rod between connecting member 47 and inner body 72 of the adjusting member 70. This shortening causes the connecting member 47 to move within slots 46 and 58 and raises the end of the lower carrier 34 closest to the lock side 20. The end of the lower carrier 34 closest to the lock side 20 of the door 10 can be lowered by turning rod 74 counter-clockwise within threaded bore 47*a* to lengthen the section of rod 74 between the connecting member 47 and the inner body 72 of the adjusting member 70. Likewise, when rod 76 is turned in a clockwise direction, the threaded end portion 80 turns within threaded bore 48*a* of connecting member 48 to shorten the section of rod 76 between connecting member 48 and inner body 73 of adjustment member 71. This shortening of the section of rod 76 causes connecting member 48 to move within slots 44 and 56 and raises the end of the lower carrier 34 closest to the hinge side 16 of door 10. The end of the lower carrier 34 closest to the hinge side 16 can be lowered by turning rod 76 in a counter-clockwise direction within the threaded bore 48*a* to lengthen the section of rod 76 between connecting member 48 and the inner body 73 of adjusting member 71.

The above-described adjustable door sweep and method of using the adjustable door sweep provide advantages over other door sweeps available on the market. The adjustable door sweep of the present invention is easy to install and easy to use. Moreover, the above-described adjustable door sweep allows vertical adjustment of the brush, and in particular allows independent adjustment of two ends of the brush vertically with respect to the front, back, and sides of a door.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. An adjustable door sweep comprising:

an elongated upper frame having a first frame end and a second frame end and sized to extend along and adjacent a bottom of a door, the elongated upper frame comprising a top and at least one upper side wall depending therefrom, the upper side wall having a first aperture disposed closer to the first frame end than the second frame end and a second aperture disposed closer to the second frame end than the first frame end;

an elongated lower carrier having a first carrier end, a second carrier end, a lower end, an elongated base wall, and at least one lower side wall extending upwardly from the base wall, the at least one lower side wall having a third aperture and a fourth aperture therein, the third aperture being adjacent the first aperture, the fourth aperture being adjacent the second aperture;

a first connecting member extending through the first aperture in the upper side wall and extending into the third aperture of the at least one lower side wall: and a second connecting member extending through the second aperture in the upper side wall and extending into the fourth aperture of the at least one lower side wall; and an adjustment member engaged with one of the first connecting member and the second connecting member to assist in movement thereof;

the first aperture and the second aperture sized and shaped to allow movement of the first connecting member and the second connecting member therein, respectively, to allow independent vertical movement of the first carrier end and the second carrier end relative to the upper frame for adjustment of the lower end of the lower carrier relative to the upper frame.

2. The adjustable door sweep of claim 1, wherein the at least one upper side wall is two upper side walls depending from the top, and together creating an upper channel in which at least a portion of the lower carrier resides.

3. The adjustable door sweep of claim 2, wherein the at least one lower side wall is two lower side walls, both of which extend upwardly from the base wall and at least a portion of each lower side wall resides within the upper channel.

4. The adjustable door sweep of claim 3, and further comprising a first connecting rod attached to the first connecting member and a second connecting rod attached to the second connecting member, the first connecting rod and the second connecting rod each being independently rotatable for independent movement of the first connecting member and the second connecting member.

5. The adjustable door sweep of claim 4, wherein the adjustment member is a first adjustment member adjacent the first frame end and attached to the first connecting rod, the adjustable door sweep further comprising a second adjustment member adjacent the first frame end and attached to the second connecting rod, the adjustment members being disposed to assist in rotation of the first and second connecting rods for independent adjustment of the first and second connecting members.

6. The adjustable door sweep of claim 5, wherein the lower end of the lower carrier comprises at least one brush.

7. The adjustable door sweep of claim 1, and further comprising a first connecting rod attached to the first connecting member and a second connecting rod attached to the second connecting member, the first connecting rod and the second connecting rod each being independently rotatable for independent movement of the first connecting member and the second connecting member.

8. An adjustable door sweep comprising:

an elongated upper frame having a first frame end and a second frame end and sized to extend along and adjacent a bottom of a door, the elongated upper frame comprising a top, a first upper side wall depending from the top, and a second upper side wall depending from the top, the first upper side wall having a first aperture therein, the top, first upper side wall, and second upper side wall together defining an upper channel;

an elongated lower carrier having a first carrier end, a second carrier end, a bottom, an elongated base wall, a first lower vertical wall extending upwardly from the base wall and having a first upper edge and a second aperture, and a second lower vertical wall extending upwardly from the base wall and having a second upper edge, the first upper edge and the second upper edge each being disposed within the upper channel;

a connecting member engaged with the second aperture of the first lower vertical wall and extending through the first aperture in the first upper side wall; and a rotatable elongated connecting rod attached to the connecting member for movement of the connecting member, wherein the first aperture and the second aperture are sized and shaped to allow movement of the connecting member therein to allow movement of the bottom of the lower carrier with respect to the elongated upper frame.

9. The adjustable door sweep of claim 8, and further comprising an adjustment member attached to the connecting rod for assisting in rotation of the connecting rod.

10. The adjustable door sweep of claim 9, wherein the first aperture is an elongated slot extending longitudinally in a direction other than vertical.

11. The adjustable door sweep of claim 10, wherein the first aperture of the first upper side wall is a first slot, and the second upper side wall has a second slot therein.

12. The adjustable door sweep of claim 8, further comprising an extension depending from the elongated lower carrier.

13. A door comprising:

a front panel;

a back panel;

a hinge side;

a lock side;

the front panel, back panel, hinge side, and lock side defining a bottom portion; and an adjustable door sweep comprising:

an elongated upper frame disposed along and adjacent the bottom portion of the door, the elongated upper frame comprising a top and at least one upper side wall depending therefrom;

an elongated lower carrier having a longitudinal axis, a first end, a second end, a bottom, an elongated base wall, and a lower side wall extending upwardly from the base wall, the lower side wall disposed lengthwise substantially parallel to the longitudinal axis of the lower carrier;

a first connecting member engaged with the lower side wall and the upper side wall; and a second connecting member engaged with the lower side wall and the upper side wall, the first connecting member and the second connecting member each being independently adjustable so as to allow independent vertical movement of the first end and the second end of the elongated lower carrier with respect to the upper frame.

14. The door of claim 13, wherein the upper side wall has a first aperture therein through which the first connecting member extends, and a second aperture therein through which the second connecting member extends.

15. The door of claim 14, wherein each of the first connecting member and the second connecting member is independently movable within the respective apertures in the upper side wall.

16. A method of adjusting a door sweep comprising:

(a) providing a door comprising a front panel, a back panel, a hinge side, a lock side, and a bottom portion;

(b) providing an adjustable door sweep comprising:

an elongated upper frame extending along and adjacent the bottom portion of the door, the elongated upper frame comprising at least one upper side wall having a first aperture therein being disposed closer to the hinge side than the lock side, and a second aperture therein being disposed closer to the lock side than the hinge side;

an elongated lower carrier having a bottom, an elongated base wall, at least one lower side wall extending upwardly from the base wall, a first end adjacent the hinge side, and a second end adjacent the lock side;

a first connecting member engaged with and extending through a third aperture in the at least one lower side wall and extending through the first aperture in the upper side wall; and a second connecting member engaged with and extending through a fourth aperture in the at least one lower side wall and extending through the second aperture in the upper side wall; and (c) moving the first connecting member with respect to the upper frame upper side wall to the desired position within the first aperture to place the first end of the lower carrier at a desired vertical position.

17. The method of claim 16, further comprising the step of:

(d) moving the second connecting member with respect to the upper frame upper side wall to the desired position within the second aperture to place the second end of the lower carrier at a desired vertical position.

* * * * *